US006029715A

United States Patent [19]

Matsumoto et al.

[11] Patent Number: 6,029,715

[45] Date of Patent: Feb. 29, 2000

[54] METHOD OF CONTROLLING PILE WARP TENSION ON PILE FABRIC LOOM

[75] Inventors: Masato Matsumoto; Zenji Tamura, both of Kanazawa, Japan

[73] Assignee: Tsudakoma Kogyo Kabushiki Kaisha, Ishikawa-ken, Japan

[21] Appl. No.: 09/166,281

[22] Filed: Oct. 5, 1998

[30] Foreign Application Priority Data

Oct. 6, 1997 [JP] Japan ..... 9-289123
Oct. 7, 1997 [JP] Japan ..... 9-290402

[51] Int. Cl.[7] ..... D03D 49/10

[52] U.S. Cl. ..... 139/102; 139/25; 139/105

[58] Field of Search ..... 139/102, 25, 105, 139/103

[56] References Cited

U.S. PATENT DOCUMENTS 4,884,597 12/1989 Tamura et al. .
5,002,095 3/1991 Herrin et al. ..... 139/25
5,029,616 7/1991 Deconnick ..... 139/25

*Primary Examiner*—Andy Falik
*Attorney, Agent, or Firm*—Wenderoth, Lind & Ponack, L.L.P.

[57] ABSTRACT

A pile warp tension control method uses a pile warp tension control device capable of adjusting the tension of pile warp yarns according to a weave on a pile fabric loom. The pile warp tension control method involves setting a first pile warp tension amount for a pile weave section weaving mode for use in weaving a pile weave section, and setting second pile warp tension amounts for ground weave section weaving modes, respectively, for use in weaving ground weave sections, where the second pile warp tension amounts are higher than the first pile warp tension amounts. The control method further involves gradually increasing the tension of the pile warp yams from the first pile warp tension amount toward a selected one of the second pile warp tension amounts in a predetermined period after the change of the operating mode of the pile fabric loom from the pile weave section weaving mode to the ground weave section weaving mode. The control method next involves adjusting the tension of the pile warp yarns to the selected second pile warp tension amount after the end of the predetermined period.

5 Claims, 7 Drawing Sheets

METHOD OF CONTROLLING PILE WARP TENSION ON PILE FABRIC LOOM

BACKGROUND OF THE INVENTION

1. Field of the Invention

The present invention relates to a method of adjusting the tension of pile warp yarns according to weaving modes on a pile fabric loom (pile loom). In this specification, a direction from a let-off mechanism toward a take-up mechanism is referred to as the "forward direction" and the opposite direction is referred to as the "backward direction". The term, "fast pick" signifies a pick driven completely from a shed into the cloth fell of a woven fabric on a loom by beating, and the term, "loose pick" signifies a pick driven halfway and not beaten completely into the cloth fell.

2. Description of the Related Art

A method of controlling the tension of pile warp yarns on a shifting fell type (moving cloth type) pile fabric loom and a device for carrying out the method are disclosed in JP-A No. 2622685)(U.S. Pat. No. 4,884,597. FIG. 1 shows a pile warp tension regulating device 1 disclosed in the foregoing cited reference, and FIG. 2 illustrates a process of forming a pile during a weaving operation for weaving a three-pick towel fabric (three-pick pile fabric) by way of example.

Referring to FIG. 1, the pile warp tension regulating device 1 regulates the tension of pile warp yarns 2 so that the pile warp yarns 2 are fed to the cloth fell 4*a* of a pile fabric (terry cloth) 4 at a desired tension. The pile warp yarns 2 released from a pile warp beam 6 travel via a guide roller 7 and a tension roller 8 to the cloth fell 4*a* of the pile fabric 4. A tension lever 9 has one end rotatably supporting the tension roller 8, and the other end fixedly connected to the output shaft of a motor 10, i.e., rotative drive source. The torque, the rotating speed and the angular stopping position of the output shaft of the motor 10 are controllable.

The pile fabric loom is of, for example, a shifting fell type which moves the cloth fell of the fabric forward and backward to form piles. The pile fabric 4 moves forward and backward on the pile fabric loom during a weaving operation and the tension lever 9 turns to move the tension roller 8 forward and backward accordingly to permit the pile warp yarns 2 to move forward and backward. Although not shown in FIG. 1, the pile fabric loom is provided with a ground warp beam, a tension control device for controlling the tension of ground warp yarns 3, a take-up control device for controlling a take-up operation for taking up the pile fabric 4, a shedding mechanism, a terry motion mechanism for moving the cloth fell 4*a* of the pile fabric 4, and such.

While the pile fabric loom is in a weaving operation, a warp beam driving unit 11 drives the pile warp beam 6 to let off pile warp yarns 2. The warp beam driving unit 11 has a speed calculating unit 14 and a current amplifier 15. The speed calculating unit 14 receives a displacement signal expressing a measured displacement of the tension roller 8 measured by a displacement sensor 12 and a desired displacement signal provided by a desired displacement setting device 13, and provides a speed signal expressing the deviation between the displacement signal and the desired displacement signal, the current amplifier 15 amplifies the speed signal to provide a drive signal for driving a let-off motor 16 for operation to let off the pile warp yarns 2.

The motor 10 for driving the tension lever 9 for turning is controlled by a pile warp tension controller 20. The pile warp tension controller 20 includes a driving unit 22, a tension control signal generating unit 17 which generates a tension signal for making the motor 10 generate a predetermined torque, a speed control signal generating unit 18 which generates a speed signal for driving the motor for operation at a predetermined operating speed, and an stopping angular position control signal generating unit 19 which generates an stopping angular position control signal expressing an angular position at which the output shaft of the motor 10 is to be stopped. The tension signal, the speed signal and the angular stopping position control signal are given selectively to the driving unit 22 by selectively closing switches 21.

The switches 21 are closed selectively according to the mode of weaving operation to send the speed signal to the driving unit 22 to weave a fast pick in the loop forming cycle when the pile fabric loom operates in a fast pick weaving mode, to send the tension signal to the driving unit 22 to weave a loose pick in the loop forming cycle when the pile fabric loom operates in a loose pick weaving mode and to send the angular stopping position control signal to the driving unit 22 when changing the mode of weaving operation from the fast pick weaving mode to the loose pick weaving mode and vice versa. The driving unit 22 executes a speed control operation, a tension (torque) control operation or an stopping angular position control operation according to the signal given thereto.

The pile warp yams 2 are controlled at a relatively low first tension for the loose pick weaving mode for forming piles (loops), and at a relatively high second tension for the fast pick weaving mode for weaving the ground fabric. The ground fabric includes all the parts of the pile fabric excluding piles, such as borders and hems. FIG. 2 is a diagrammatic view comparatively illustrating the operating speed of the pile fabric loom, operation periods of the loop fabric loom, control modes of the pile warp tension control unit 20, and the variation of the tension of the pile warp yarns for weaving a three-pick towel fabric (three-pick pile fabric). One complete pattern of the weave of the three-pick towel fabric (for forming one loop) is completed by inserting three picks, i.e., by three rotations of the crankshaft of the pile fabric loom. Since the pile fabric loom is of a shifting fell type, picks (weft yarn which is inserted into shed) are beaten at a fixed beating position and the pile fabric 4 is moved once forward and backward every three picks, ie., every three rotations of the crankshaft of the loop fabric loom to form piles of a desired length between the beating position and the cloth fell 4*a* of the pile fabric 4.

Referring to FIG. 2, piles are formed in a state (1), the cloth fell 4*a* is shifted forward to the front position to insert loose picks in states (2), (3) and (4), and the cloth fell 4*a* is shifted backward to the back position to weave a fast pick in states (5) and (6). In operation periods R1, R2 and R3, the crankshaft of the pile fabric loom is in the first rotation cycle, in the second rotation cycle and a first half of the third rotation cycle and in the second half of the third rotation cycle, respectively.

In the state (1), i.e., a state immediately after the completion of pile formation, the pile fabric loom is in the rotation period R1, the cloth fell 4*a* is moved forward by a predetermined distance by a terry motion mechanism, not shown, the pile warp tension control unit 20 executes a speed control operation V to supply a current corresponding to a speed signal to the motor 10, and the motor 10 turns the tension lever 9 forward in the state (2) to displace the tension roller 8 forward by a distance corresponding to the distance by which the cloth fell 4*a* is moved forward Thus the tension lever 9 is turned prior to the forward movement of the cloth fell 4*a* to slacken the pile warp yarns 2 temporarily.

Consequently, the tension of the pile warp yarns is reduced to a level which will not cause mislooping, i.e., failure in forming piles.

Then, the pile warp tension control unit 20 starts an angular stopping position control operation B, and gives an angular stopping position control signal to the motor 10 to stop the motor 10 so that the tension lever 9 is stopped at a predetermined position. On the other hand, the terry motion mechanism, not shown, moves the pile fabric 4 forward continuously to change the tension of the pile warp yarns 2 from a low tension to a set tension. Since the excessive forward movement of the tension roller 8 is inhibited by the angular stopping position control operation B, the forward turning of the tension lever 9 can be stopped and the tension lever 9 is kept stably in a stopped state.

Meanwhile, head frames 23 are moved for shedding motion to form a shed by the pile warp yarns 2 and the ground warp yarns 3. A picking mechanism, not shown, picks a weft yarn 5 in a first pick 5 indicated at 1 into the shed. The first pick 5 is beaten up by a reed 24 at the back beating position. In this state, the loom operates to produce a loose loose pick.

In the rotation period R2 for the states (3), (4) and (5), a second and a third pick 5 indicated at 2 and 3 in FIG. 2 are picked, and the terry motion mechanism moves the pile fabric backward to form piles. Meanwhile the pile warp tension control unit 20 executes a tension control operation T and a current corresponding to a desired tension signal is supplied to the motor 10. Consequently, the tension lever 9 is turned forward and backward according to the shedding motion so that the torque of the motor 10 and the sum of the tensions of the pile warp yarns 2 balance each other. Thus, the tension of the pile warp yarns 2 are maintained always at a set tension.

In the rotation period R3, the pile warp tension control unit 20 executes an angular stopping position control operation B to stop the tension roller 8 by braking the motor 10 in the state (6). That is, two picks 5 have been inserted in the shed in the states (2) and (3), then the first pick state (5), namely, the cloth fell 4*a* is moved backward to the beating position, a third pick 5 indicated at 3 is inserted, and thereafter the tension roller 8 stops as shown in the state (6) so that the third pick 5 is beaten by the reed 24. Consequently, the pile warp yarns 2 held by the two picks 5 form piles of a predetermined length corresponding to a reed clearance, ie., the distance of forward movement of the cloth fell 4*a* from the beating position in the state (6).

In this one pile forming cycle of the pile fabric weaving (pile weaving) operation, the three picks 5 are inserted and each pile warp yarn 2 forms one pile while the crankshaft of the pile fabric loom makes three full turns. When the fast pick is woven in the pile forming cycle, the tension of the pile warp yarns 2 are kept at a desired relatively low tension by the tension control operation T. When a ground fabric weaving (plain weaving) cycle (for example, a border weaving or hem weaving) is started after the pile forming cycle has been repeated a predetermined number of times, the cloth fell 4*a* is not shifted and fast picks are woven consecutively, the pile warp tension control unit 20 executes the tension control operation T subsequent to the angular stopping position control operation B to keep the pile warp yarns 2 at a desired tension suitable for weaving the ground fabric.

A general known technique disclosed in JP-U No. 2-74386 sets desired pile warp tension amounts respectively for border weave sections and pile weave sections, and executes a tension control operation to keep the pile warp yarns at the desired pile warp tension to weave pile weave sections. More concretely, the desired pile warp tension for weaving pile weave sections is relatively low and the desired pile warp tension for weaving border weave sections is relatively high. Since the pick density of border weave sections is high, the tension of the pile warp yarns is increased when weaving border weave sections to ensure successful picking, and the same is reduced when weaving pile weave sections.

Problems in the Prior Art

When changing the weaving operation of the pile fabric loom from a pile weave section weaving mode to a border weave section weaving mode, the prior art increases the tension of the pile warp yarns instantaneously while the pile warp yarns are not effectively gripped by the ground warp yarns and the picks and, consequently, a high tension for the border weave (section weaving mode is exerted on the loose piles formed by reducing the tension of the pile warp yarns and thereby the piles formed in the pile, weave section are stretched and mislooping results.

Since the yarn density of the ground weave greater than that of the pile weave sections, the cloth fell moves backward after beating during the weaving operation for weaving the ground weave sections. The reed clearance is reduced by such backward movement of the cloth fell after beating even if the tension of the pile warp yarns is reduced when changing the weaving operation from the ground weave section weaving mode to the pile fabric weaving mode. Consequently, it is possible that the quality of the pile fabric is deteriorated by short piles of a length shorter than the desired pile length formed immediately after the change of the operating mode of the pile fabric loom from the ground weave section weaving mode to the pile weave section weaving mode and by failure in forming piles.

SUMMARY OF THE INVENTION

Accordingly, it is an object of the present invention to prevent the occurrence of mislooping due to stretching of piles formed immediately before the change of the operating mode of a pile fabric loom from a pile weave section weaving mode to a ground weave section weaving mode during the progress of the ground fabric weaving operation subsequent to the pile fabric weaving operation.

Another object of the present invention is to prevent misslooping in pile weave sections liable to occur in a period immediately after the change of operating mode of a pile fabric loom from a ground weave section weaving mode for weaving a ground fabric of a ground weave such as a border weave or a hem weave to a pile weave section weaving mode.

With the foregoing object in view, according to a first aspect of the present invention, a pile warp tension control method uses a pile warp tension control device capable of adjusting the tension of pile warp yarns according to a weave on a first pile fabric loom, and comprises: setting a pile warp tension amount for a pile weave section weaving mode for weaving a pile weave section, and setting second warp tension amount higher than the first pile warp tension amount, for ground weave section weaving modes, respectively, for weaving ground weave sections; gradually increasing the tension of the pile warp yarns from the set pile warp tension for the pile weave section weaving mode toward one of the second pile warp tension amounts in a predetermined period after the change of the operating mode of the pile fabric loom from the pile weave section weaving mode to the ground weave section weaving mode, and adjusting the tension of the pile warp yarns to the one of the second pile warp tension amounts after the end of the predetermined period.

According to a second aspect of the present invention, a pile warp tension control method uses a pile warp tension control device capable of adjusting the tension of pile warp yarns according to a weave on a pile fabric loom, and comprises: setting a first pile warp tension amount for a pile weave section weaving mode for weaving a pile weave section, and setting pile warp tension amount higher than the first pile warp tension amounts for ground weave section weaving modes for weaving ground weave sections; and adjusting the tension of the pile warp yarns to a second pile warp tension amount lower than the first pile warp tension amount in a first period immediately after the change of the operating mode of the pile fabric loom from the ground weave section weaving mode to the pile weave section weaving mode.

The tension of the pile warp yarns may be increased gradually from the second pile warp tension amount toward the first pile warp tension amount in a second period subsequent to the first period, and the tension of the pile warp yarns may be adjusted to the first pile warp tension amount after the end of the second period.

Thus, mislooping liable to occur when the operating mode of the pile fabric loom is changed from the ground weave section weaving mode to the pile weave section weaving mode can be prevented.

In a process of driving the tension roller in synchronism with the movement of the cloth fell when a fast pick is woven when forming piles, the tension roller is displaced temporarily by a displacement greater than a displacement by which the tension roller is displaced during a regular weaving operation.

According to a third aspect of the present invention, a pile warp tension control method of controlling pile warp tension on a pile fabric loom by winding pile warp yarns around a tension roller supported for forward and backward movement on a roller support, and displacing the tension roller in forward and backward directions, comprises: a position control process of forcibly displacing the tension roller at a speed corresponding to a previously set first displacement amount in a direction to reduce pile warp tension; a tension control process of exerting a torque corresponding to a previously set tension amount about a center of swing motion of the tension roller to the tension roller; and an angular stopping position control process of holding the tension roller at a predetermined position in a predetermined period.

The position control process is executed when a fast pick is woven during a weaving operation in a pile weave section weaving mode, the tension control process is executed on the basis of a set pile warp tension for the pile weave section weaving mode when weaving a loose pick, the angular stopping position control process is executed when the mode of operation of the pile fabric loom is changed from a fast pick weaving mode to a loose pick weaving mode or from the loose pick weaving mode to the fast pick weaving mode, the tension control process is executed during a ground weave section weaving mode on the basis of a set tension set for the ground weave section weaving mode, and the tension roller is displaced by a second displacement greater than the first displacement by the position control process in a first period after the change of the operating mode of the pile fabric loom from the ground weave section weaving mode to the pile weave section weaving mode.

The displacement of the tension roller may be decreased gradually from the second displacement amount toward the first displacement amount by the position control process in a second period subsequent to the first period, and the displacement of the tension roller may be adjusted to the first displacement amount after the end of the second period.

DESCRIPTION OF THE PREFERRED EMBODIMENT

First Embodiment

A pile warp tension control method in a first embodiment according to the present invention, employs the pile warp tension controller 20 previously described with reference to FIG. 1, and forms piles by the same steps as those previously described with reference to FIG. 2.

Figure 3:
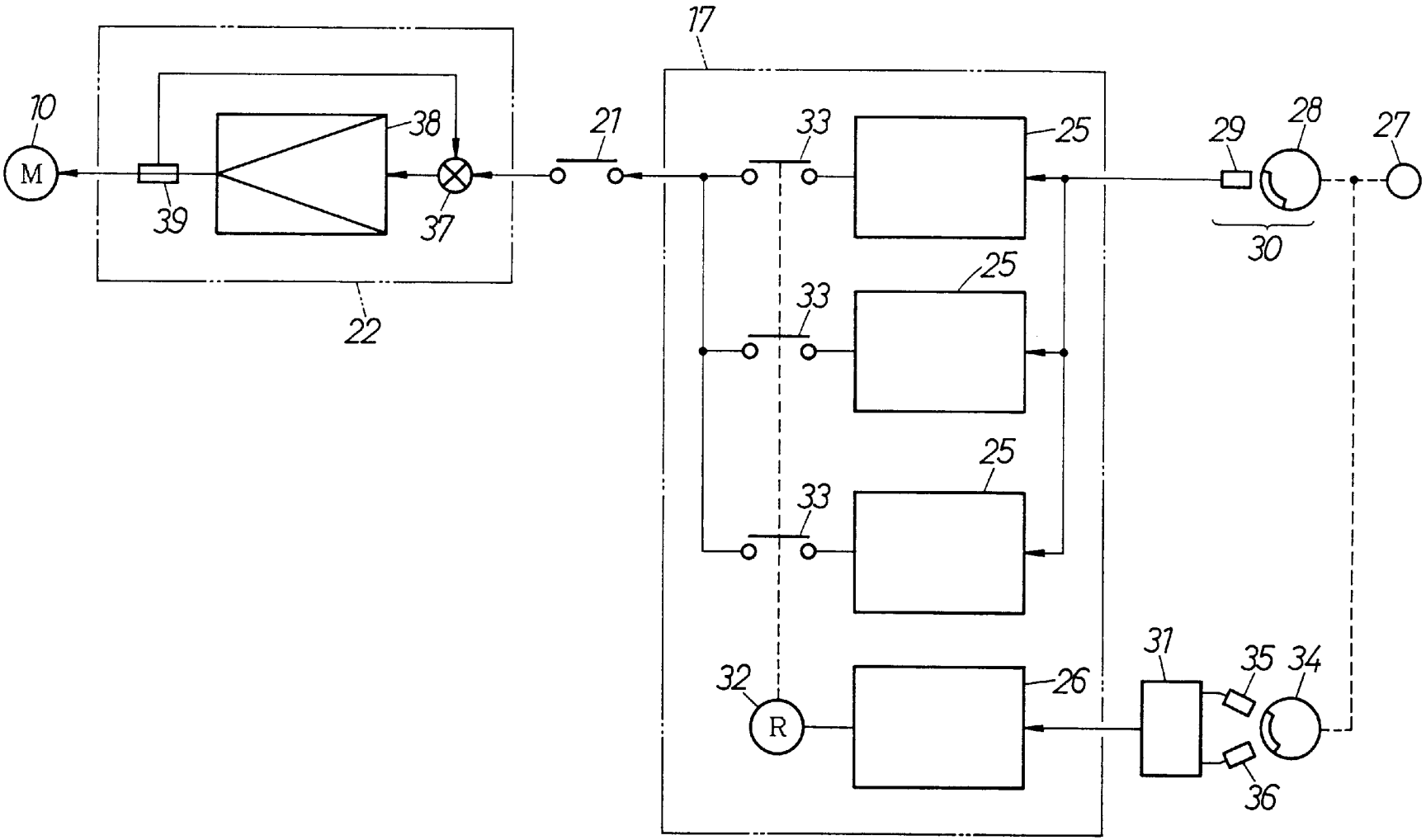
FIG. 3 is a block diagram of a tension control signal generating unit.

Referring to FIG. 3, the tension control signal generating unit 17 comprises a plurality of tension control signal generators 25, i.e., a first, a second, . . . and an nth tension control signal generator 25, and a selection signal generator 26. The first, the second, . . . and the nth tension control signal generator 25 store predetermined tension control patterns as functions of the angular position of the crankshaft 27 of the pile fabric loom respectively for weaving modes including a pile weaving mode, a border weaving mode and a hem weaving mode.

The angular position of the crankshaft 27 is measured by a timing signal generator 30 having a dog 28 connected to the crankshaft 27, and a proximity switch 29. A timing signal generated by the timing signal generator 30 is given to the tension control signal generators 25. Each of the tension control signal generator 25 generates tension signals at predetermined angular positions of the crankshaft 27 so that the tension is varied in a set tension control pattern.

The selection signal generator 26 counts pulses of a stepping signal generated by a stepping signal generator 31, and provides a selection signal corresponding to the count of the pulses of the stepping signal indicating a picking step. A relay 32 selectively turns on a switch 33 connected to the output of the tension control signal generator 25 specified by the selection signal. Consequently, a tension signal generated by the selected tension control signal generator 25 is given to the driving unit 22. The stepping signal generator 31 detects a dog 34 connected to the crankshaft 27 by two proximity switches 35 and 36, and provides a step signal at a predetermined angular position of the crankshaft 27.

A current amplifier 38 included in the driving unit 22 gives a current corresponding to the tension signal given to the driving unit 22 by the selected tension control signal generator 25 to the motor 10 to drive the motor 10. A current sensor 39 measures the output current of the current amplifier 33 and feeds back the measured output current to an add point 37 connected to the input of the current amplifier 38. The driving unit 22 measures the current supplied to the motor 10 and drives the motor 10 so that the motor 10 generates a torque corresponding to a set tension signal.

A tension control signal generator selection command specifying the selection of the plurality of tension control signal generators 25 is set in the selection signal generator 26 beforehand in connection with a weave command for every picking step. During the weaving operation, the selection signal generator 26 provides a predetermined selection signal corresponding to the picking step determined by counting the step signals provided when the crankshaft 27 is at a predetermined angular position, the plurality of switches 33. The switch 33 specified by the predetermined selection signal is closed to send the output tension signal of the tension signal generator 25 connected to the closed switch 33 to the driving unit 22. Generally, the pile fabric loom is provided with a shedding controller, which gives electric signals for operating heads to an electronic dobby or an electronic jacquard, in combination with a shedding motion. The selection signal generator 26 is used also as the shedding controller.

In the pile weave section weaving mode, the speed control operation V and the stopping position control operation B are executed in the pile forming steps, while the tension control operation T for controlling the tension of the pile warp yarns 2 is executed. The tension control operation T selects the tension control signal generator 25 for the pile weave section weaving mode, signals representing desired pile warp tensions are provided for picking steps, and the tension of the pile warp yarns 2 is adjusted to the desired pile warp tensions. The tension set for the tension control signal generator 25 may be determined either in connection with picking or regardless of picking. The pile warp yarns 2 are thus controlled to form piles.

When the operating mode of the pile fabric loom is changed from the pile weave section weaving mode to a border weave section weaving mode for weaving one of ground fabrics, a switch 21 is operated to execute the tension control operation T, and the selection signal generator 26 of the tension control signal generating unit 17 generates a selection signal corresponding to the change of the operating mode of the pile fabric loom. The switch 33 connected to the tension control signal generator 25 for the border weave section weaving mode is closed to select the same tension control signal generator 25. The selected tension control signal generator 25 is set previously for a tension control pattern for picking steps, and gives a tension command expressing a set tension corresponding to the input picking step on the basis of the tension control pattern to the driving unit 22.

Figure 4:
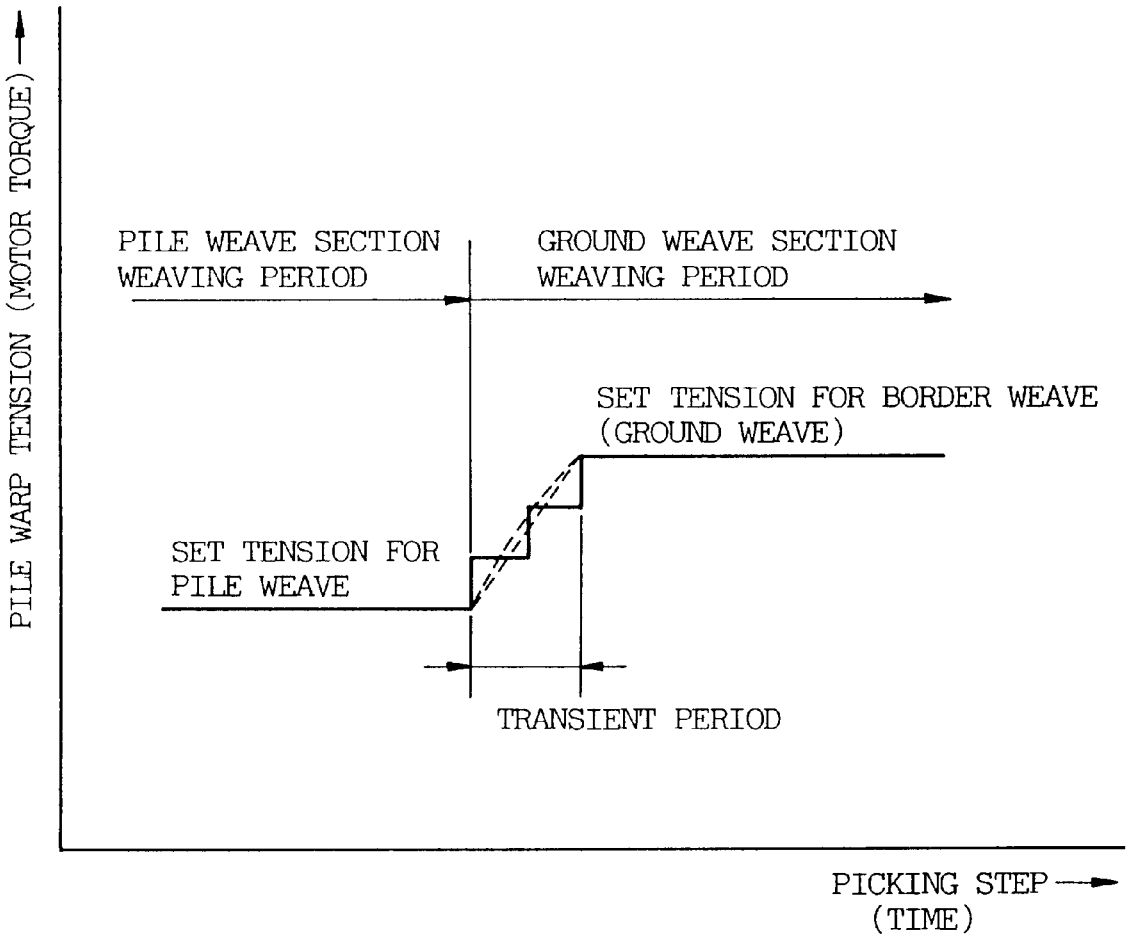
FIG. 4 is a graph showing a set tension control pattern in which pile warp tension (torque) is changed with time in a period in which the operating mode of a pile fabric loom changes from a pile weave section weaving mode to a ground weave section weaving mode.

The tension control pattern is determined so that the pile warp tension is increased gradually in a predetermined tension control pattern in a predetermined period subsequent to the change of the operating mode of the pile fabric loom from the pile weave section weaving mode to the ground weave section weaving mode to prevent mislooping, and then the pile warp tension is increased to a set tension after the end of the predetermined period. For example, as shown in FIG. 4, a tension control pattern is determined on the basis of tensions for weaves, such as a pile weave and a border weave, tension varying period, tension varying rate, and tension increasing mode (stepping mode, and linear mode curved mode). The tension control signal generators 25 are set for tension control patterns thus determined, respectively. The predetermined tension varying period subsequent to the change of the operating mode of the pile fabric loom from the pile weaving mode to the ground weaving mode must be at least a period in which the pile retaining effect of the ground warp yarns and the picks is increased sufficiently, i.e., a period necessary for the ground warp yarns and the picks to secure piles. The tension control pattern is designed to increase the tension of the pile warp yarns gradually from the relatively low pile warp tension for the pile weave section weaving mode toward the relatively high pile warp tension for the border weave section weaving mode, and to increase the tension to the relatively high pile warp tension after the end of the tension varying period.

The tension control pattern may automatically be produced through automatic calculation using set parameters or may empirically be produced. Practically, the tension control pattern is designed so that the tension of the pile warp yarns is increased from the relatively low pile warp tension for the pile weave section weaving mode to the relatively high pile warp tension for the border weave section weaving mode in several to ten-odd picks. The pile warp tension may be increased in steps as shown in FIG. 4, or continuously as indicated by dashed lines in FIG. 4.

Generally, a plurality of border weave sections, such as a first border weave section, a second border weave section, . . . and hem weave sections, are formed in one piece of the pile fabric (e.g. one towel). Therefore, the tension control signal generators 25 are set for tension control patterns suitable for combinations of pile weave sections and those border weave sections, respectively. If a plurality of kinds of pile weave sections are formed in one piece of the pile fabric, the tension control signal generators 25 are set for tension control patterns suitable for combinations of pile weave sections of different pile weaves and border weave sections. An appropriate tension control pattern is selected every time the operating mode of the pile fabric loom is changed.

The configuration of the tension control signal generating unit 17 may be other than that shown in FIG. 3. The tension control signal generating unit 17 functions according to the picking step (picking operation). The tension control signal generating unit 17 may function according to time elapsed after the change of the operating mode of the pile fabric loom. The tension control signal generator 25 may comprise a tension setting device for a regular state and a differential signal generating device which generates a differential signal in response to picking. The level of the differential signal is determined so that mislooping may not occur.

Figure 1:
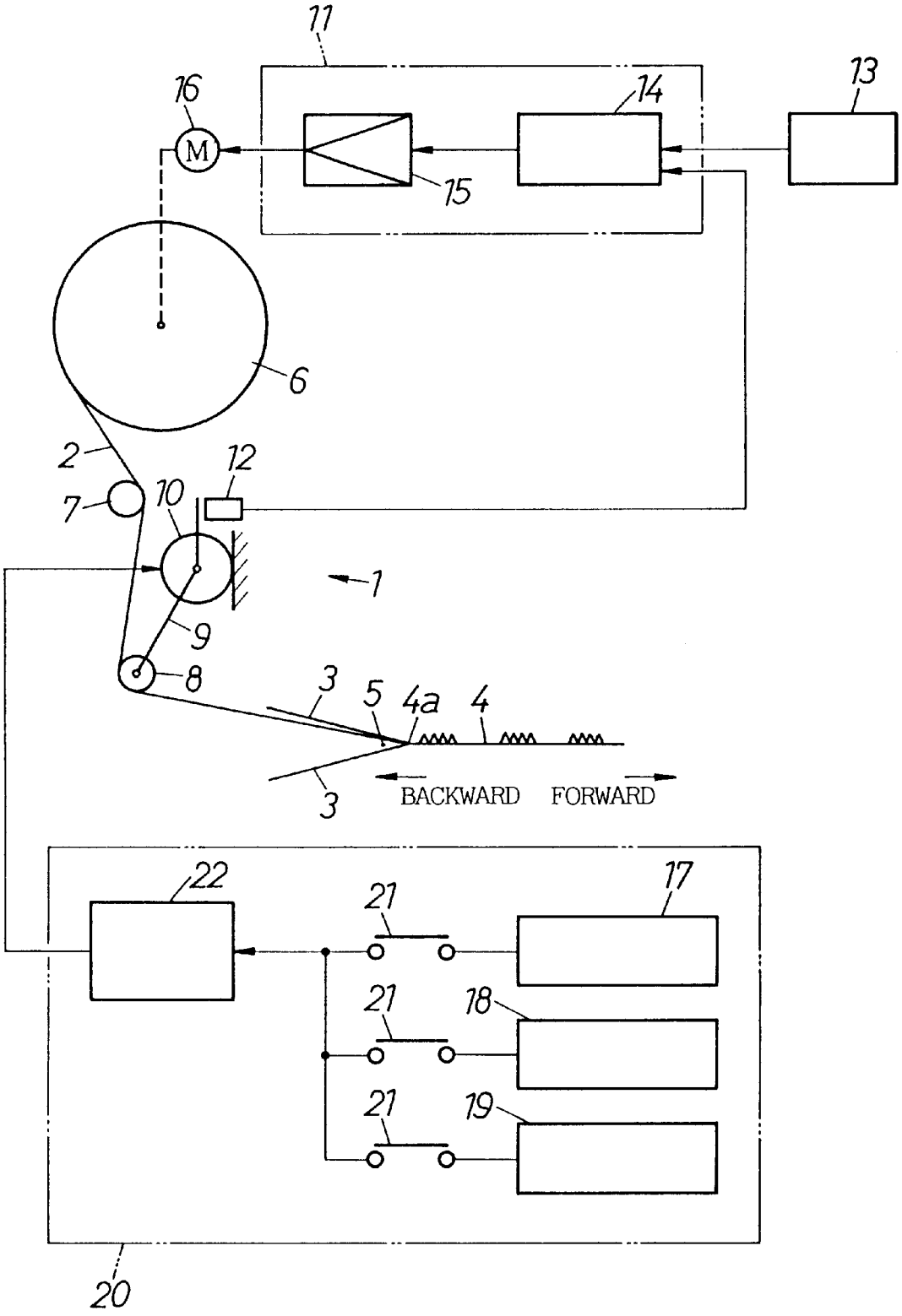
FIG. 1 is a block diagram of a pile warp tension adjusting device and a pile warp tension control device.
Figure 2:
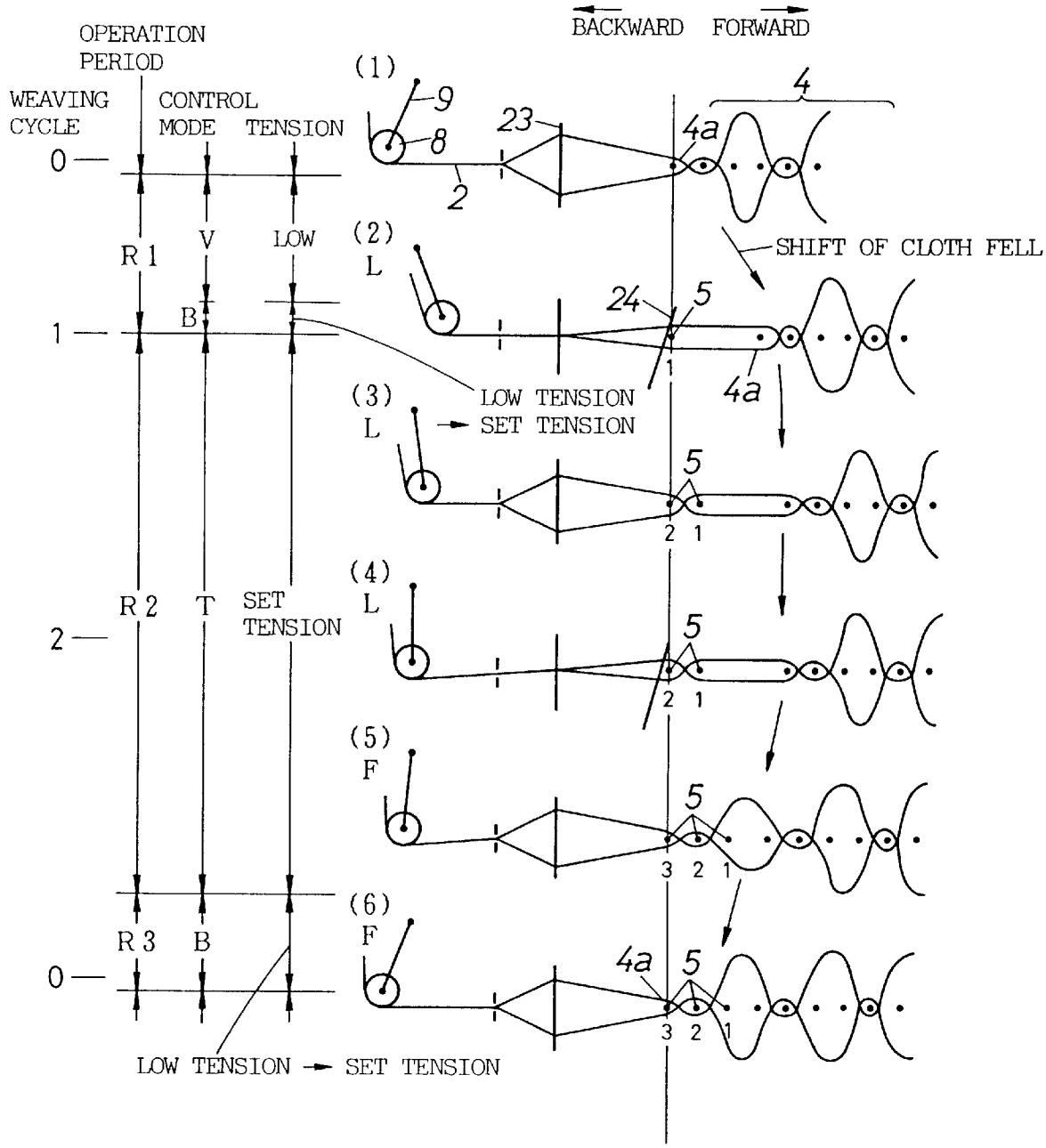
FIG. 2 is a diagrammatic view for use in explaining a pile forming process.

The pile warp tension control method in this embodiment can be carried out by a pile warp tension regulating device other than the pile warp tension regulating device 1 shown in FIG. 1, such as a pile warp tension regulating device which regulates the pile warp tension through the control of the rotation of the warp beam. A pile fabric loom other than the shifting fell type pile fabric loom, such as a shifting reed type pile fabric loom, may be used. The pile warp tension controller 20 may be provided with a plurality of tension control signal generating units similar to the tension control signal generating unit 17 for different operating speeds, respectively, of the pile fabric loom. If the pile warp tension controller 20 is provided with a plurality of tension control signal generating units, an optimum tension control pattern can be altered according to the change of the operating speed of the pile fabric loom to prevent mislooping.

Since the pile warp tension control method increases the tension of the pile warp yarns gradually from the pile warp tension for the pile weave section weaving mode toward the pile warp tension for the ground weave section weaving mode in the predetermined period subsequent to the change of the operating mode of the pile fabric loom from the pile weave section weaving mode to the ground weave section weaving mode, piles formed immediately before the change of the operating mode are not stretched and hence mislooping can be prevented.

Second Embodiment

A pile warp tension control method in a second embodiment according to the present invention uses devices of configurations similar to those of the devices shown in FIG. 1 and 3.

While the pile fabric loom is operating in a ground weave section weaving mode for weaving a border weave section, i.e., a section of one of ground weaves, the switch 21 selects the continuous tension control operation T. The tension control signal generating unit 17 generates a selection signal for selecting the tension control signal generator 25 for a border weave section. The tension control signal generator 25 corresponding to the border weave section is selected through the relay 32 and the switch 33. The selected tension control signal generator 25 is set beforehand for a tension control pattern and provides a tension control signal expressing set tensions for picking steps according to the set tension control pattern.

When the operating mode of the pile fabric loom is changed from the border weave section weaving mode to the pile weave section weave mode, a control operation for the pile weave section weave mode is executed according to the movement of a pile fabric 4. More concretely, the speed control signal generating unit 18, the tension control signal generating unit 17 and the angular stopping position control signal generating unit 19 are selected sequentially by the switch 21 according to a pile weave section weaving process. More specifically, as the fabric moves by the movement of the terry motion mechanism, a speed control operation V corresponding to a first displacement is executed when a fast pick is woven, an angular stopping position control operation B is executed when the weaving mode of the pile fabric loom is changed from a loose pick weaving mode to a fast pick weaving mode, a tension control operation T corresponding to a first tension is executed when a loose pick is woven, and the angular stopping position control operation B is executed again when the weaving mode of the pile fabric loom is changed from the loose pick weaving mode to the fast pick weaving mode. Thus the loom operates according these control operations for forming one loop. These control operations are repeated sequentially to weave a pile weave section.

Appropriate tensions are set respectively for different ground weaves including the hem weave. Picks (weft yarn) 5 are inserted in a ground weave section in a pick density greater than that of the pile weave section. Generally, when picks are beaten in a thick density, the pick density of the fabric coincides with a design pick density after a plurality of beating cycles due to the backward movement of the cloth fell 4*a*. Therefore, when the weaving mode of the pile fabric loom is changed from the ground weave section weaving mode to the pile weave section weaving mode to execute the series of pile warp tension control operations, reed clearance for weaving a loose pick is reduced by a value corresponding to the backward movement of the cloth fell 41, which causes mislooping.

According to the present invention, when the operating mode of the pile fabric loom is changed from the border weave section weaving mode to the pile weave section weaving mode, the tension control signal generating unit 17 provides a tension control signal expressing a second tension lower than the first tension for the tension control operation T to be selectively executed in a specific period (namely, loose pick period) during the loop forming process after the change of the operating mode of the pile fabric loom from the ground weave weaving mode to the pile weave weaving mode. More preferably, the set pile warp tension is increased gradually from the second tension toward the first tension in a period from the end of the first period to the start of the second period and is adjusted to the first tension after the end of the second period. When the operating mode of the pile fabric loom is changed from the border weave section weaving mode to the pile weave section weaving mode and the tension control operation T is executed during a period for weaving a loose pick, the tension roller 8 is controlled to reduce the pile warp tension to the second tension. Consequently, the cloth fell 4*a* moves to a position for the regular pile weave section weaving mode to cancel out the insufficiency of the reed clearance to prevent mislooping.

Figure 5:
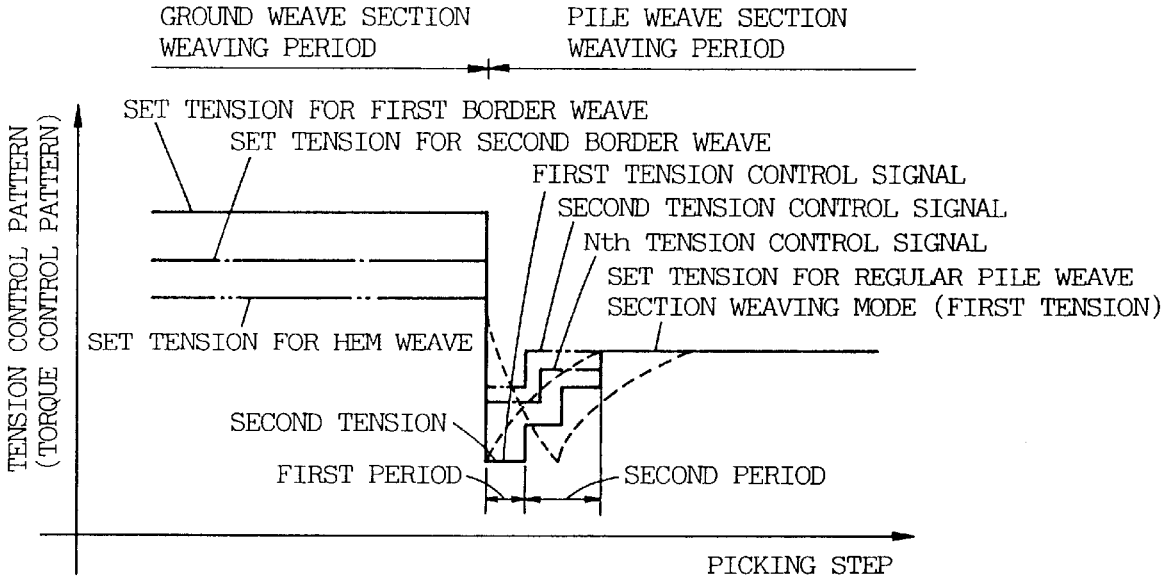
FIG. 5 is a graph showing a set tension control pattern in which pile warp tension (torque) is changed with time in a period in which the operating mode of the pile fabric loom changes from a ground weave section weaving mode to a pile weave section weaving mode.

FIG. 5 shows a set tension control pattern (torque control pattern) in which the tension of pile warp yarns is controlled by the tension control operation T during a period for weaving a loose pick when the operating mode of the pile fabric loom is changed from the ground weave section weaving mode to the pile weave section weaving mode. The tension signal generators 25 to be selected respectively for weaving ground weave sections including a first border weave section, a second border weave section and a hem weave section specify appropriate pile warp tensions, respectively. A tension control signal generated by the tension signal generator 25 selected for the pile weave section weaving mode keeps the tension of the pile warp yarns at a second tension lower than a first tension for the pile weave section weaving mode in a first period from the change of the operating mode of the pile fabric loom from the ground weave section weaving mode to the pile weave section weaving mode, increases the tension of the pile warp yarns gradually from the second pile warp tension toward the first pile warp tension in a second period subsequent to the first period, and adjusts the tension of the pile warp yarns to the first pile warp tension at the end of the second period. Thus the tension control signal generating unit 17 reduces the torque of the motor 10, and then increases the tension of the pile warp yarns gradually toward the first pile warp tension for the pile weave section weaving mode. Practically, the tension control pattern is designed so that the tension of the pile warp yarns is increased from the second pile warp tension to the first pile warp tension in several to ten-odd picks.

The second pile warp tension, i.e., the lowest pile warp tension for the pile weave section weaving mode, the first period and the second period depend on weaving conditions for weaving the preceding ground weave section and the pile weave section. Parameters for setting the tension control pattern are the set pile warp tension for the ground weave section weaving mode, the first and the second pile warp tension for the pile weave section weaving mode, the number of picks to be inserted in the first period, the number of picks to be inserted in the second period, and the rate of changing the pile warp tension and such. The tension control pattern (torque control pattern) is designed on the basis of these parameters so that mislooping may not occur. The tension control pattern may automatically be produced through automatic calculation using set parameters or may empirically be produced. Practically, the tension control pattern is designed so that the tension of the pile warp yarns 2 is increased to the first pile warp tension for the pile weave section weaving mode in several to ten-odd picks, the reed clearance is adjusted to a value for the regular pile weave section weaving mode, the pile fabric loom is operated continuously in the pile weave section weaving mode, and the tension of the pile warp yarns 2 reaches the set pile warp tension for the pile weave section weaving mode after the cloth fell has been returned to its normal position. Desirably, the set tension is not changed when weaving a loose pick in one weaving cycle, i.e., in a torque control region.

The set tension control pattern may be designed so that the pile warp tension is changed in steps, or continuously along a straight line, a curved line or a composite curved line indicated by dotted lines in FIG. 5. The pile warp yarns may instantaneously be tensioned at the second tension and may immediately be tensioned at the first tension for the pile weave section weaving mode instead of tensioning the pile warp yarns at the second tension and gradually increasing the tension toward the desired tension.

Generally, a plurality of border weave sections, such as a first border weave section, a second border weave section, . . . and hem weave sections, are formed in one piece of the pile fabric (e.g. on towel). Therefore, the tension control signal generators 25 are set for tension control patterns suitable for combinations of pile weave sections and those border weave sections, respectively. If a plurality of kinds of pile weave sections are formed in one piece of the pile fabric, the tension control signal generators 25 are set for tension control patterns suitable for combinations of pile weave sections of different pile weaves and border weave sections.

The configuration of the tension control signal generating unit 17 may be other than that described above. The tension control signal generating unit 17 shown in FIG. 3 functions according to the picking step. The tension control signal generating unit 17 may function according to time elapsed after the change of the operating mode of the pile fabric loom. The tension control signal generator 25 may comprise a tension setting device for a regular state and a differential signal generating device which generates a differential signal in response to picking. The level of the differential signal is determined so that mislooping may not occur. The pile warp tension control method in this embodiment can be carried out by a pile warp tension regulating device other than the foregoing pile warp tension regulating device 1, such as a pile warp tension regulating device which regulates the pile warp tension through the control of the rotation of the warp beam.

Third Embodiment

A pile warp tension control method in a third embodiment according to the present invention, uses devices of configurations similar to those of the devices shown in FIG. 1, and forms piles by the same steps as those previously described with reference to FIG. 2.

The third embodiment changes the set tension by the speed control operation V which shifts the tension lever 9 to a predetermined position when weaving a fast pick instead of the tension control operation T to be executed in the pile forming process after the weaving mode is changed from the ground weave section weaving mode to the pile weave section weaving mode. The moving speed of the tension lever 9 (the integration of the same with respect to time is displacement) is varied. The tension lever 9 is driven for movement at a second speed corresponding to a second displacement and higher than a first speed corresponding to a first displacement for a regular state, and the moving speed of the tension lever 9 is reduced gradually toward the first speed with the progress of the speed control operation V for the next weaving cycle.

More specifically, when the operating mode of the pile fabric loom is changed from the border weave section weaving mode to the pile weave section weaving mode, the speed control signal generating unit 18 generates a speed control signal to move the tension lever 9, which is moved as the pile fabric is moved backward, by the second displacement greater than the first displacement in a first period after the change of the operating mode of the pile fabric loom from the border weave section weaving mode to the pile weave section weaving mode. More preferably, the displacement of the tension lever 9 is reduced gradually from the second displacement toward the first displacement in a second period subsequent to the first period, and is adjusted to the first displacement after the end of the second period, that is, a speed control signal generator 40 gives the motor 10 a speed control signal to move the tension lever 9 at the speed corresponding to the second displacement in the first period after the start of the pile weave section weaving mode, to decrease the speed of the tension lever 9 from the speed corresponding to the second displacement toward the speed corresponding to the first displacement in the second period subsequent to the first period and to adjust the speed of the tension lever 9 to the speed corresponding to the first displacement. When the operating mode of the pile fabric loom is changed from the border weave section weaving mode to the pile weave section weaving mode, the displacement of the tension roller 8 is increased beyond a displacement for a regular state by the speed control operation V as the cloth fell 4*a* is shifted backward when weaving a fast pick. Consequently, the cloth fell 4*a* is shifted to a position for a regular pile weave section weaving operation before weaving a loose pick to cancel out the insufficiency of the reed clearance to prevent mislooping.

Figure 6:
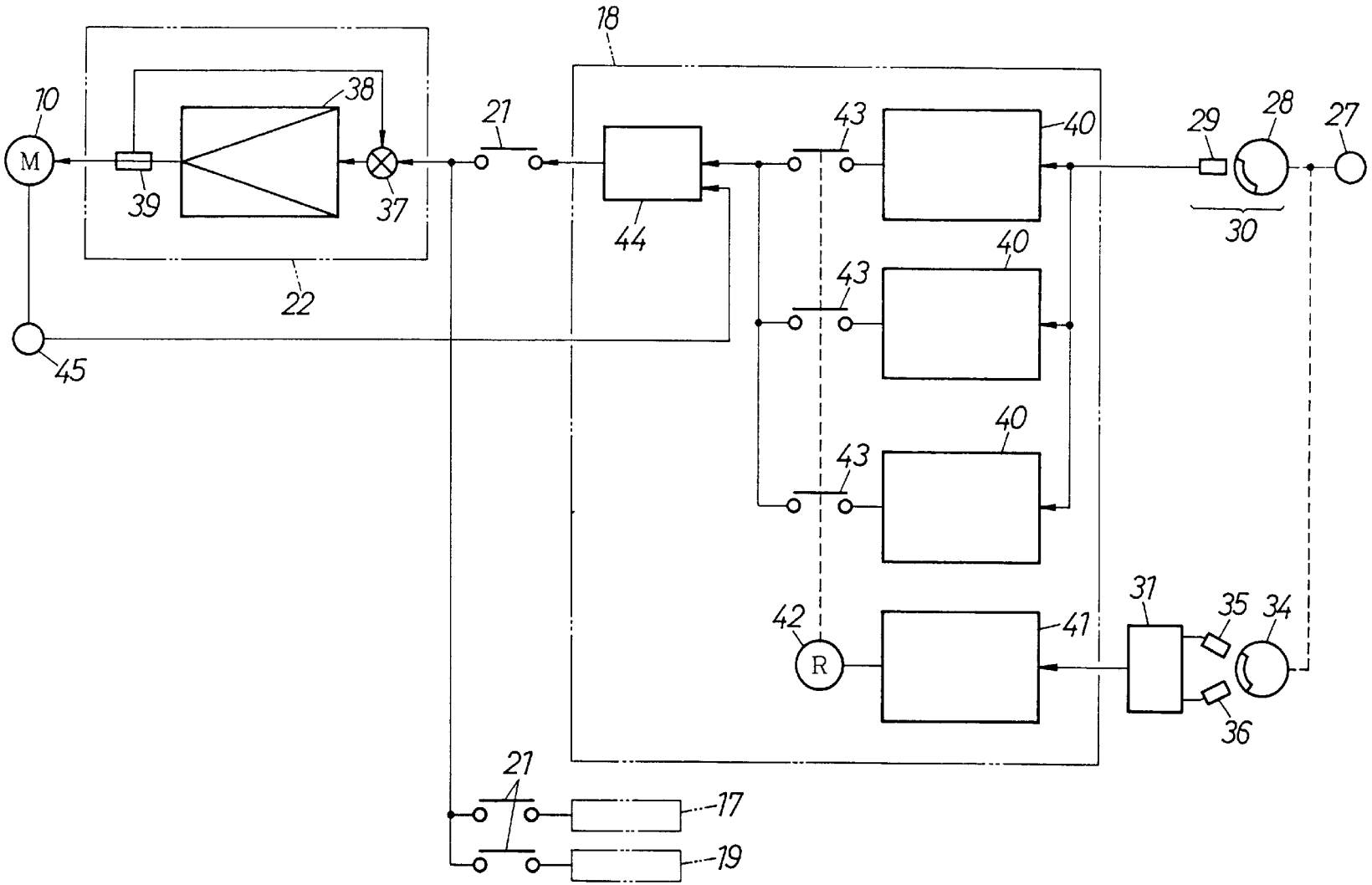
FIG. 6 is a block diagram of a speed command signal generating unit.

Referring to FIG. 6, the construction of the speed control signal generating unit 18 comprises a plurality of speed control signal generators 40 and a selection signal generator 41. The first, the second, . . . and the nth speed control signal generator 40 generate speed control signals for controlling the motor 10 when the operating mode of the pile fabric loom is changed from ground weave section weaving modes to the pile weave section weaving mode, respectively. Each of the speed control signal generator 40 is set for a desired displacement corresponding to a picking step after the start of the pile weave section weaving mode, and a speed control pattern calculated on the basis of the set desired displacement and set parameters for weaving a fast pick in a pile forming process. The selection signal generator 41, similarly to the selection signal generator 26, receives a picking step signal, and generates a selection signal for selecting one of the speed control signal generators 40 corresponding to the change of the operating mode of the pile fabric loom from the ground weave section weaving mode to the pile weave section weaving mode. A relay 42 closes one switch 43 connected to the speed control signal generator 40 specified by the selection signal.

Each speed control signal generator 40 counts input timing signals and provides a speed control signal corresponding to the count of the timing signals (picks). The speed control signal is sent through the switch 43 to one of the input terminals of a speed calculator 44. The speed calculator 44 provides a speed signal corresponding to the deviation of an actual speed from a desired speed to a driving unit 22. The actual operating speed of the motor 10 is measured by a tachometer generator 45 connected to the motor 10.

Figure 7:
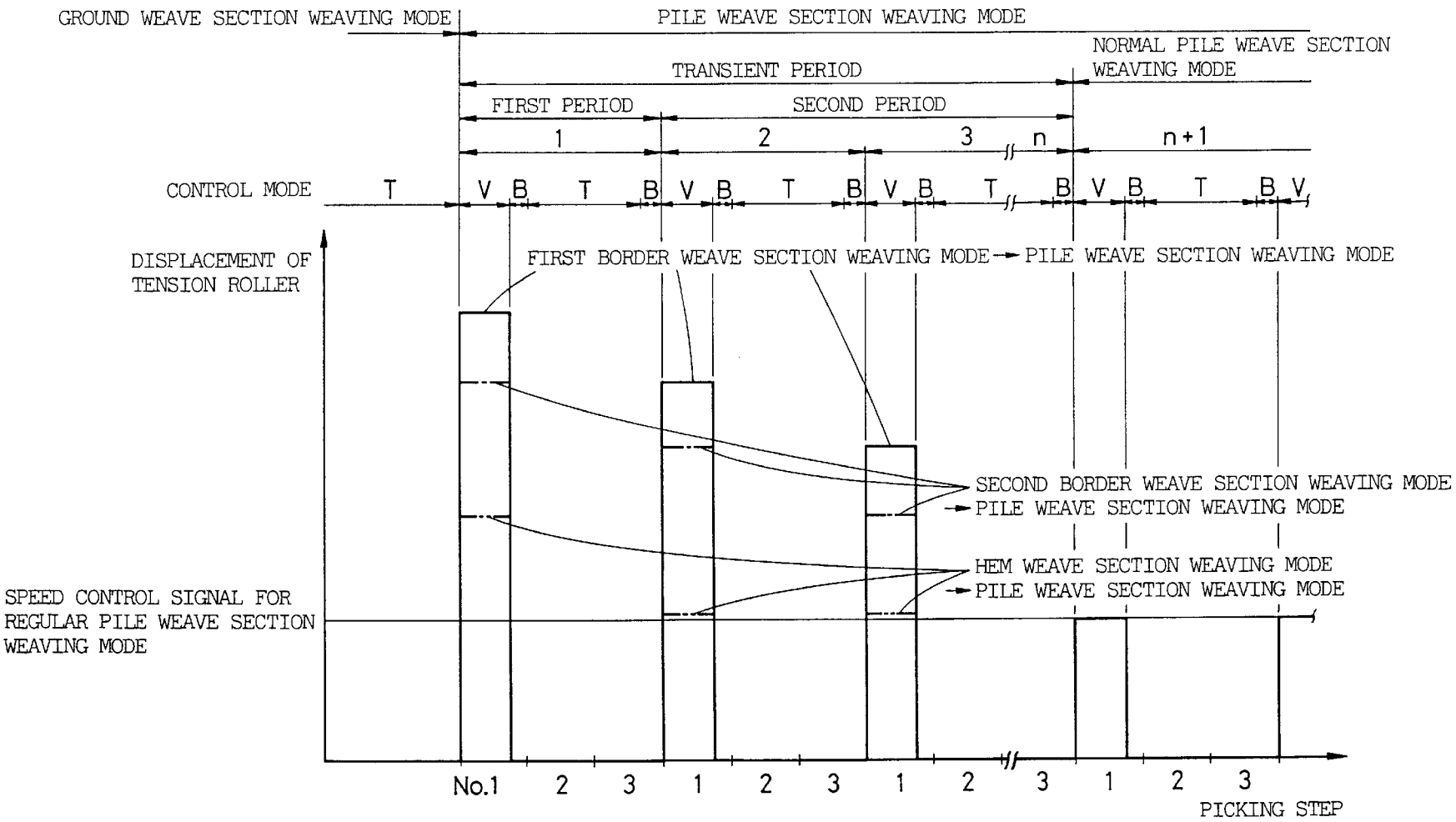
FIG. 7 is a diagrammatic view for use in explaining a set tension control pattern in which a tension roller is displaced in a period in which the operating mode of a pile fabric loom is changed from a ground weave section weaving mode to a pile weave section weaving mode.

FIG. 7 shows a position control process for fast picks when the operating mode of the pile fabric loom is changed from the ground weave section weaving mode to the pile weave section weaving mode, i.e., a displacement control pattern (speed command pattern) in which the speed control operation V controls the tension lever 9. In FIG. 7, reference characters V, T and B indicate the speed control operation, the tension control operation and the angular stopping position control operation for controlling pile warp yarns in a pile forming process, respectively. Each speed control signal generator 40 is set for a control pattern which, when the operating mode of the pile fabric loom is changed from the border weave section weaving mode to the pile weave section weaving mode, displaces the tension roller by the speed control operation V when a fast pick is woven by the second displacement greater than the first displacement for the regular pile weave section weaving mode in a first period from the start of the pile weave section weaving mode, decreases the displacement of the tension roller 8 gradually from the second displacement toward the first displacement in a second period subsequent to the first period, and the adjusts the displacement to the first displacement at the end of the second period. The speed control signal generator 40 gives a speed control signal to move the tension lever 9 at a speed corresponding to the second displacement in the first period after the start of the pile weave section weaving mode, to decrease the speed gradually from the speed corresponding to the second displacement to a speed corresponding to the first displacement in the second period subsequent to the first period, and to adjust the speed to the speed corresponding to the first displacement at the end of the second period. The motor 10 is controlled by a control system according to the speed control signal provided by the speed control signal generator 40.

Practically, the speed control signal is set so that the displacement is decreased gradually from the second displacement to the first displacement in several picking cycles. The tension control operation T is executed during the insertion of a loose pick, and the angular stopping position control operation B is executed in a transient period between a loose pick and a fast pick.

Thus, the displacement of the tension roller 8 is decreased gradually from the second displacement toward the first displacement and is eventually adjusted to the first displacement for the regular pile weave section weaving mode in every tension roller control cycle. Although the tension roller control cycle shown in FIG. 7 decreases the displacement of the tension roller 8 stepwise, the displacement may be decreased continuously at a fixed rate in a period for the speed control operation V. Weaving conditions for weaving the ground weave section preceding the pile weave section, such as warp tension, weave (such as a plain weave, a twill weave, a satin weave or a modified weave) and weaving conditions for weaving the pile weave section (such as loop length) are parameters for designing a tension roller control pattern in which the displacement of the tension roller 8 is controlled. Naturally, the second period may be omitted, and the displacement may immediately be adjusted to the first displacement.

The configuration of the speed control signal generating unit 18 may be other than that described above. The speed control signal generating unit 18 may function according to time elapsed after the change of the operating mode of the pile fabric loom instead of according to the picking operation. The speed control signal generator 40 may comprise a regular speed setting device and a differential signal generating device which generates a differential signal in response to picking. The level of the differential signal is determined so that mislooping may not occur.

The foregoing embodiments may individually be applied to practical use or may be applied to practical use in combination. The present invention can be carried out by a pile warp tension regulating device other than the foregoing pile warp tension regulating device 1, such as a pile warp tension regulating device which regulates the pile warp tension through the control of the rotation of the warp beam. A pile fabric loom other than the shifting fell type pile fabric loom, such as a shifting reed type pile fabric loom, may be used. A plurality of tension control signal generating units similar to the tension control signal generating unit 17 may be employed for different operating speeds, respectively, of the pile fabric loom. If a plurality of tension control signal generating units are employed, an optimum pile warp tension can be altered according to the change of the operating speed of the pile fabric loom to prevent mislooping attributable to an inappropriate pile warp tension.

This embodiment reduces temporarily the torque for driving the tension roller when weaving a loose pick after the change of the operating mode of the pile fabric loom from the ground weave section weaving mode to the pile weave section weaving mode, and moves the tension roller by a displacement greater than the displacement for a regular state when weaving a fast pick after the start of the pile weave section weaving mode. Consequently, the insufficiency of the reed clearance due to the backward shift of the cloth fell caused during the ground weave section weaving operation can be canceled out and a desired reed clearance is set and thereby mislooping is prevented and piles can reliable be formed.

What is claimed is:

1. A pile warp tension control method using a pile warp tension control device capable of adjusting the tension of pile warp yarns according to a weave on a pile fabric loom so as to prevent mislooping due to change of operating mode from a pile weave section weaving mode to a ground weave section weaving mode, said pile warp tension control method comprising:

setting a first pile warp tension amount for a pile weave section weaving mode for use in weaving a pile weave section, and setting a second pile warp tension amount for a ground weave section weaving mode, respectively, for use in weaving a ground weave section, said second pile warp tension amount being higher than said first pile warp tension amount;

adjusting the tension of the pile warp yarns from said first pile warp tension amount to said second pile warp tension amount in a predetermined period after the change of the operating mode of the pile fabric loom from the pile weave section weaving mode to the ground weave section weaving mode, by gradually increasing the tension of the pile warp yarns from said first pile warp tension amount toward said second pile warp tension amount.

2. A pile warp tension control method using a pile warp tension control device capable of adjusting the tension of pile warp yarns according to a weave on a pile fabric loom so as to prevent mislooping due to change of operating mode from a ground weave section weaving mode to a pile weave section weaving mode, said pile warp tension control method comprising:

setting a first pile warp tension amount for a pile weave section weaving mode for use in weaving a pile weave section, and setting a second pile warp tension amount for a ground weave section weaving mode for use in weaving a ground weave section, said second pile warp tension amount being higher than said first pile warp tension amount; and adjusting the tension of the pile warp yarns to a second pile warp tension amount lower than said first pile warp tension amount in a first period immediately after the change of the operating mode of the pile fabric loom from the ground weave section weaving mode to the pile weave section weaving mode.

3. The pile warp tension control method according to claim 2, further comprising adjusting the tension of the pile warp yarns from the second pile warp tension amount to the first pile warp tension amount in a second period subsequent to the first period, by gradually increasing the tension of the pile warp yarns from the second pile warp tension amount toward the first pile warp tension amount.

4. A pile warp tension control method of controlling pile warp tension on a pile fabric loom by winding pile warp yarns around a tension roller supported for forward and backward movement on a roller support, and displacing the tension roller in forward and backward directions so as to prevent mislooping due to change of operating mode between a ground weave section weaving mode and a pile weave section weaving mode, said pile warp tension control method comprising:

during weaving of a first pick in the pile weave section weaving mode, performing a position control process by forcibly displacing the tension roller at a speed corresponding to a second displacement amount in a direction to reduce pile warp tension in a first period after a change of the operating mode of the pile fabric loom from the ground weave section weaving mode to the pile weave section weaving mode, and by forcibly displacing the tension roller by a first displacement amount less than the second displacement amount;

performing a tension control process by exerting upon the tension roller a torque about a center of swing motion of the tension roller such that, during weaving of a loose pick, said torque corresponds to a set pile warp tension amount for the pile weave section weaving mode and, during the ground weave section weaving mode, said torque corresponds to a tension amount set for the ground weave section weaving mode; and performing an angular stopping position control process by holding the tension roller at a predetermined position in a predetermined period when the mode of operation of the pile fabric loom is changed between a fast pick weaving mode and a loose pick weaving mode.

5. The pile warp tension control method according to claim 4, wherein, in performing said position control process, said displacement of the tension roller is decreased gradually from the second displacement amount to the first displacement amount in a second period subsequent to the first period.

* * * * *